US009867410B1

(12) United States Patent
Kloes

(10) Patent No.: US 9,867,410 B1
(45) Date of Patent: Jan. 16, 2018

(54) SPORT GLOVE WITH TIGHTENING INSERTS

(71) Applicant: Tom Kloes, Jefferson, OR (US)

(72) Inventor: Tom Kloes, Jefferson, OR (US)

( * ) Notice: Subject to any disclaimer, the term of this patent is extended or adjusted under 35 U.S.C. 154(b) by 266 days.

(21) Appl. No.: 14/918,308

(22) Filed: Oct. 20, 2015

(51) Int. Cl.
*A41D 19/00* (2006.01)
*A63B 71/14* (2006.01)

(52) U.S. Cl.
CPC ..... *A41D 19/0048* (2013.01); *A63B 71/141* (2013.01)

(58) Field of Classification Search
CPC ..... A41D 19/0048
USPC ..... 2/162, 170
See application file for complete search history.

(56) References Cited

U.S. PATENT DOCUMENTS 1,900,395 A 3/1933 Gitt
5,740,555 A 4/1998 Renegar
8,458,816 B2 6/2013 Litke

*Primary Examiner* — Katherine Moran
(74) *Attorney, Agent, or Firm* — Stevenson IP, LLC

(57) ABSTRACT

A sport glove with tightening inserts including a sport glove having a body portion and a banded cuff. A tab is attached to a left end of the cuff and is selectively foldable atop a front area of the cuff. A pair of inserts includes a female insert and a male insert. The female insert is disposed on the front area of the cuff, and the male insert is medially disposed on an interior surface of the tab. A plurality of gripping teeth is continuously disposed on the female insert, and a tension hook is disposed on a right side of the male insert. The tension hook is selectively engageable with each of the plurality of gripping teeth.

5 Claims, 3 Drawing Sheets

SPORT GLOVE WITH TIGHTENING INSERTS

BACKGROUND OF THE INVENTION

Various types of sport gloves are known in the prior art. However, what has been needed is a sport glove with tightening inserts including a sport glove having a body portion and a banded cuff. What has been further needed is for a tab to be attached to a left end of the cuff and selectively foldable atop a front area of the cuff. Lastly, what has bee needed is a female insert and a male insert. The female insert is disposed on the front area of the cuff, and the male insert is medially disposed on an interior surface of the tab. A plurality of gripping teeth is continuously disposed on the female insert, and a tension hook is disposed on a right side of the male insert. The tension hook is selectively engageable with each of the plurality of gripping teeth. The gripping teeth on the female insert and the tension hook on the male insert thus provide an effective means for better securing and tightening a sport glove while a user is engaged in such activities that include, but are not limited to, batting and golf. Instead of having to constantly retighten a sport glove by means of a hook and loop fastener, a user must tighten the sport glove with tightening inserts only once prior to engagement in the sport, which allows the user to better focus on the game.

FIELD OF THE INVENTION

The present invention relates to sport gloves, and more particularly, to a sport glove with tightening inserts.

SUMMARY OF THE INVENTION

The general purpose of the present sport glove with tightening inserts, described subsequently in greater detail, is to provide a sport glove which has many novel features that result in a sport glove with tightening inserts which is not anticipated, rendered obvious, suggested, or even implied by prior art, either alone or in combination thereof.

To accomplish this, the present sport glove with tightening inserts includes a sport glove having a body portion and a banded cuff attached to the body portion. The cuff has a front area attached to a top surface of the sport glove, a right end, a left end disposed proximal the right end, and an opening continuously disposed between the right end and the left end. A tab has a rounded first end, a second end continuously attached to the left end of the cuff, an exterior surface, and an interior surface. The tab is selectively foldable atop the front area of the cuff. A length of the tab substantially conforms to a length of the front area of the cuff. A width of the tab substantially conforms to a width of the cuff.

A pair of inserts includes a female insert and a male insert. The female insert is disposed on the front area of the cuff, and the male insert is medially disposed on the interior surface of the tab. A plurality of gripping teeth is continuously disposed on the female insert. A tension hook is disposed on a right side of the male insert. The plurality of gripping teeth and the tension hook are optionally metal. The tension hook is configured to be selectively engageable with each of the plurality of gripping teeth in order to releasably secure the cuff around a wrist of a user. The male insert is optionally a rubberized foldable tension band and, alternately, a spring-loaded tension wire having a pair of coil springs. A first of the pair of coil springs is medially attached to a top length of the wire, and a second of the pair of coil springs is medially attached to a bottom length of the wire.

Thus has been broadly outlined the more important features of the present sport glove with tightening inserts so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
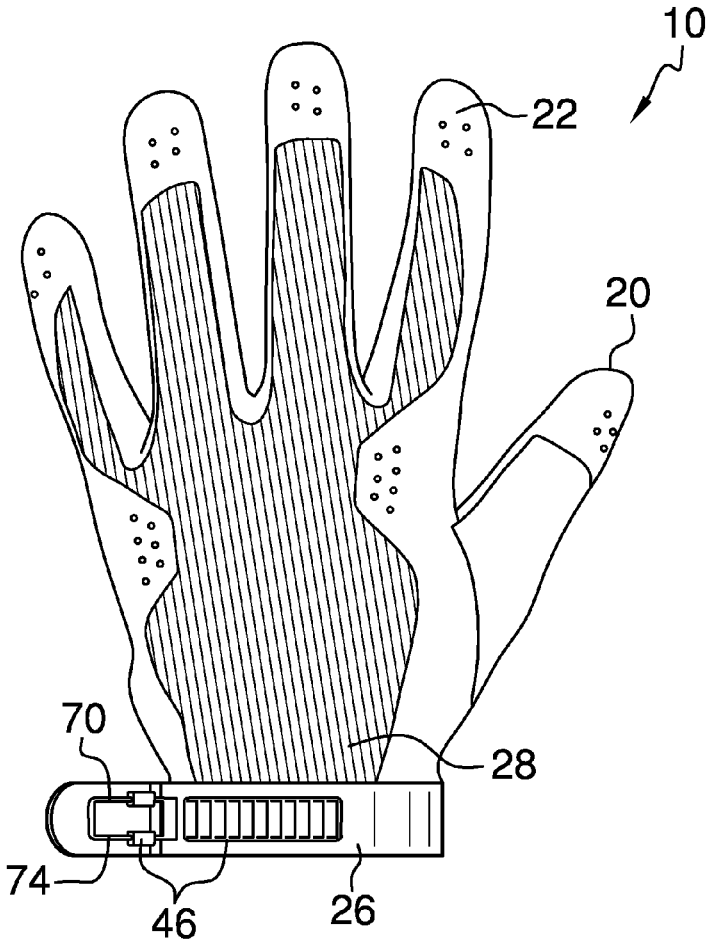
FIG. 1 is a front elevation view.
Figure 2:
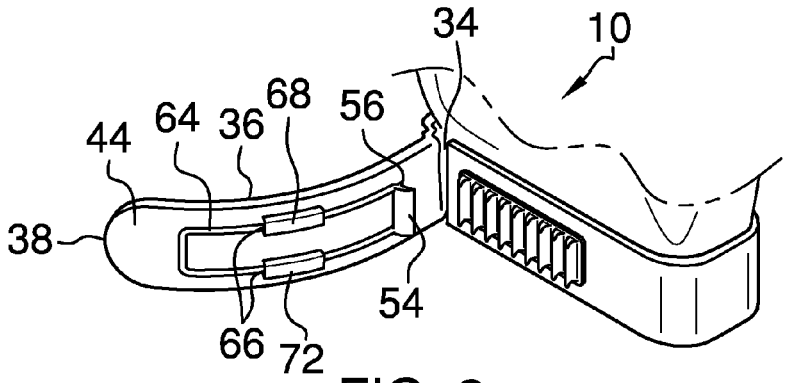
FIG. 2 is a front isometric view showing a spring-loaded tension wire and a pair of coil springs.
Figure 3:
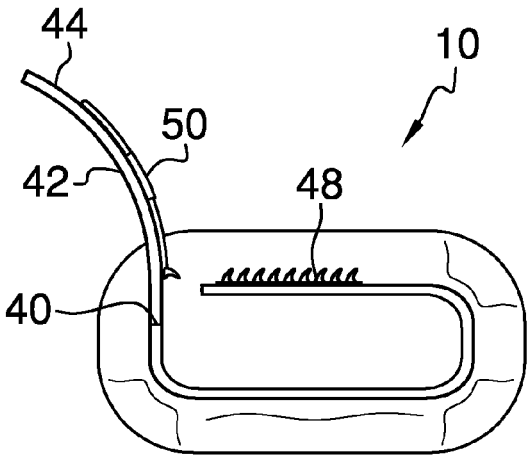
FIG. 3 is a bottom plan view.
Figure 4:
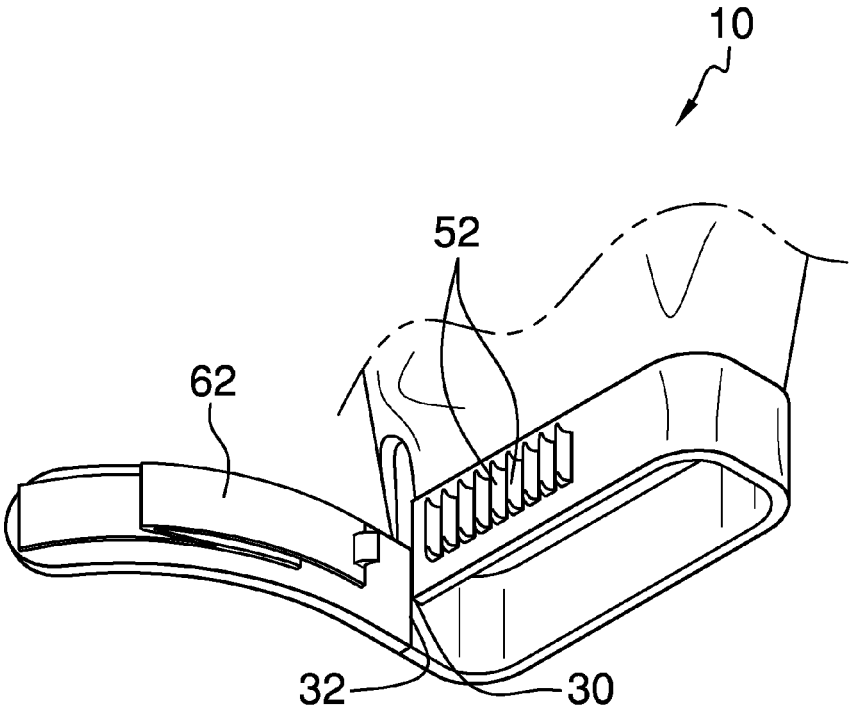
FIG. 4 is a front isometric view showing a tension band.
Figure 5:
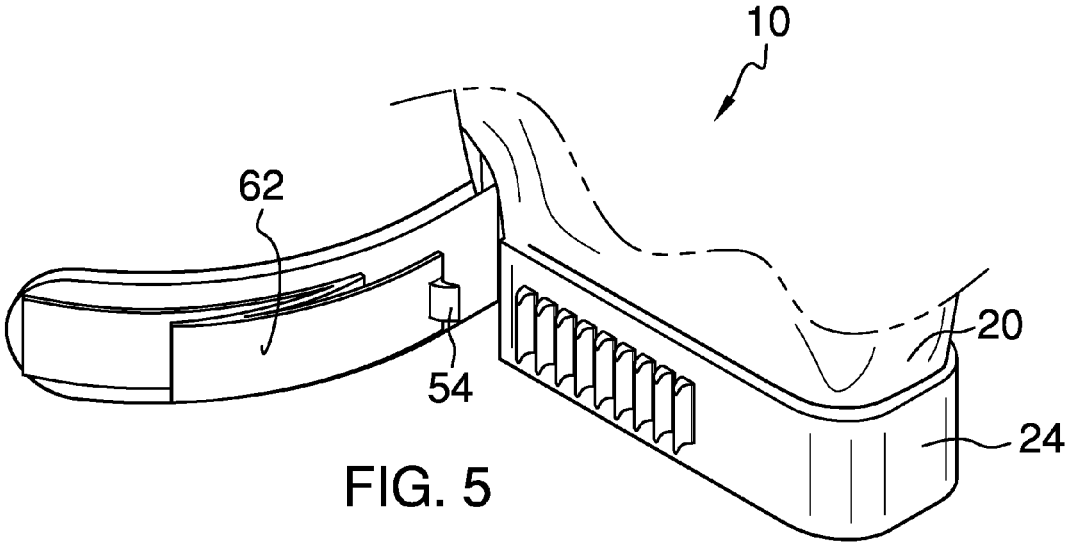
FIG. 5 is a front isometric view showing a plurality of gripping teeth.

With reference now to the drawings, and in particular FIGS. 1 through 5 thereof, an example of the instant sport glove with tightening inserts employing the principles and concepts of the present sport glove with tightening inserts and generally designated by the reference number 10 will be described.

Referring to FIGS. 1 through 5 the present sport glove with tightening inserts 10 is illustrated. The sport glove with tightening inserts 10 includes a sport glove 20 having a body portion 22 and a banded cuff 24 attached to the body portion 22. The cuff 24 has a front area 26 attached to a top surface 28 of the sport glove 20, a right end 30, a left end 32 disposed proximal the right end 30, and an opening 34 continuously disposed between the right end 30 and the left end 32. A tab 36 has a rounded first end 38, a second end 40 continuously attached to the left end 32 of the cuff 24, an exterior surface 42, and an interior surface 44. The tab 36 is selectively foldable atop the front area 26 of the cuff 24.

A pair of inserts 46 includes a female insert 48 and a male insert 50. The female insert 48 is disposed on the front area 26 of the cuff 24, and the male insert 50 is medially disposed on the interior surface 44 of the tab 36. A plurality of gripping teeth 52 is continuously disposed on the female insert 48. A tension hook 54 is disposed on a right side 56 of the male insert 50. The tension hook 54 is configured to be selectively engageable with each of the plurality of gripping teeth 52 in order to releasably secure the cuff 24 around a wrist of a user. The male insert 50 is optionally a rubberized foldable tension band 62 and, alternately, a spring-loaded tension wire 64 having a pair of coil springs 66. A first 68 of the pair of coil springs 66 is medially attached to a top length 70 of the wire 64, and a second 72 of the pair of coil springs 66 is medially attached to a bottom length 74 of the wire 64.

What is claimed is:

1. A sport glove with tightening inserts comprising:

a sport glove having a body portion and a banded cuff attached to the body portion, wherein the cuff has a front area attached to a top surface of the sport glove, a right end, a left end disposed proximal the right end, and an opening continuously disposed between the right end and the left end;

a tab having a rounded first end, a second end continuously attached to the cuff left end, an exterior surface, and an interior surface, wherein the tab is selectively foldable atop the cuff front area;

wherein a length of the tab substantially conforms to a length of the cuff front area;

wherein a width of the tab substantially conforms to a width of the cuff;

a pair of inserts comprising a female insert and a male insert, wherein the female insert is disposed on the cuff front area, and the male insert is medially disposed on the tab interior surface;

a plurality of gripping teeth continuously disposed on the female insert;

a tension hook disposed on a right side of the male insert;

wherein the tension hook is configured to be selectively engageable with each of the plurality of gripping teeth in order to releasably secure the cuff around a wrist of a user.

2. The sport glove with tightening inserts of claim 1 wherein the male insert is a rubberized foldable tension band.

3. The sport glove with tightening inserts of claim 1 wherein the male insert is a spring-loaded tension wire having a pair of coil springs, wherein a first of the pair of coil springs is medially attached to a top length of the tension wire, and a second of the pair of coil springs is medially attached to a bottom length of the tension wire.

4. The sport glove with tightening inserts of claim 2 wherein the plurality of gripping teeth and the tension hook are metal.

5. The sport glove with tightening inserts of claim 3 wherein the plurality of gripping teeth and the tension hook are metal.

* * * * *